United States Patent [19]

Romney

[11] 4,197,527

[45] Apr. 8, 1980

[54] COMPREHENSIVE INFORMATION DISPLAY SYSTEM

[76] Inventor: Russell H. Romney, 3259 Bon View Dr., Salt Lake City, Utah 84109

[21] Appl. No.: 628,786

[22] Filed: Nov. 4, 1975

Related U.S. Application Data

[63] Continuation-in-part of Ser. No. 576,127, May 9, 1975, Pat. No. 4,006,476.

[51] Int. Cl.[2] ..... G08B 5/00

[52] U.S. Cl. ..... 340/378.1; 340/381; 340/373

[58] Field of Search ..... 340/378 R, 373, 381, 340/380; 29/739

[56] References Cited

U.S. PATENT DOCUMENTS

| | | | |
|---|---|---|---|
| 2,988,738 | 6/1961 | Baker | 340/373 X |
| 3,103,659 | 9/1963 | Edwards | 340/378 |
| 3,411,151 | 11/1968 | Abernathy | 340/334 |
| 3,508,257 | 4/1970 | Grogan | 340/381 |
| 3,518,664 | 6/1970 | Taylor | 340/373 |
| 3,573,792 | 4/1971 | Reed | 340/339 |
| 3,582,927 | 6/1971 | Primavera | 340/381 |
| 3,599,046 | 8/1971 | Spreitzer | 340/381 |
| 3,704,462 | 11/1972 | Pihl | 340/373 |
| 3,742,446 | 6/1973 | Wells | 340/381 |
| 3,772,686 | 11/1973 | Chardon | 340/373 |

*Primary Examiner*—Harold I. Pitts
*Attorney, Agent, or Firm*—Edwin M. Thomas

[57] ABSTRACT

Apparatus and method are disclosed for presenting information over a display area, using a group of contiguous or substantially adjoining modules which essentially cover the area. Each module is made up of contiguously arranged elements, capable of presenting alternatively either a luminous (highly visible) or a non-luminous (much less visible) aspect. By selectively operating or energizing chosen elements in groups within each module, characters or symbols are presented which, collectively over the group of modules, presents the information to be displayed. Each module comprises a mounting base and an associated printed circuit board, referred to as a satellite board, having conductive element connected to each element of the module so that each element may be activated or energized, or deactivated selectively. The modules, in turn, are mounted so that the satellite board is connected electrically to a higher order control master or major printed circuit board. The latter is controlled, in turn, by mechanical or electronic means to selectively energize or activate the desired elements in all the modules, thus to present the information to be displayed. Each element has an incandescent electric light or a rotatable part having luminous and non-luminous aspects. Accessory means for changing color or, surface texture or reflective characteristics, etc., can be applied to each element or in selected elements and/or modules; similarly, background surfaces appearing between elements may be changed in color, aspect, etc. Special combination connector conductor means are provided between individual elements and the module base and other connectors are provided between modules and larger units, including the necessary conductive components to connect electrically the master board or circuit with satellite or module circuits. Novel aspects of connector and mounting devices are an important feature of the invention.

7 Claims, 23 Drawing Figures

FROM FIG. 1

10
M
34
90
PRIMARY MODULE
65
66
67
63
L
63
64
BASIC FRAME SUB-ASSEMBLY
81
82
P
105
84
70
HARNESS KIT
85
86
84
O
PS
88
89
PRINTED CIRCUIT KIT
Q
63
67
SUPPORT FRAME "A"
81
67
S
SUPPORT FRAME "B"
63
SELECT AND ASSEMBLE
M
R
ONE SECONDARY MODULE
(9 PRIMARY MODULES)
(3 FT. X 3 FT.)
T
TEN SECONDARY MODULES
(6 FT. X 15 FT.)
U
WELCOME
BOY SCOUTS
OF AMERICA
COMPREHENSIVE
INFORMATION DISPLAY
SYSTEM

COMPREHENSIVE INFORMATION DISPLAY SYSTEM

The present application is a continuation in part of Application Ser. No. 576,127, filed by the present inventor on May 9, 1975, now U.S. Pat. No. 4,006,476, issued Feb. 1, 1977.

BACKGROUND AND PRIOR ART

In the past, changeable signs and other information display devices and systems have sometimes been made up of multiple major components which, in themselves, are also made up of smaller components, such as incandescent electric lamp associated in modules and selectively activated, by switching means, to present intelligible characters or symbols. For purposes of the present invention, those visible elements which, in the composite, make up the information to be displayed, will be referred to as "luminous", whereas the blanks, or unlighted or relatively invisible areas between will be referred to as "non-luminous", as a matter of convenience. That is, a surface, component or element of the sign which contributes in a visual aspect to the information being displayed will be considered "luminous" whether it actually gives off light (as in the case of an incandescent lamp bulb) or merely reflects light from some other source, as in the case of a white or light colored area which is more visible than the surrounding background. In the case of dark colored display characters, such as black or other dark colored letters on a white or other light colored background, the term luminous will be understood as referring to the character defining part, and not to the background, regardless of the actual amount of light emanated or reflected.

In the past, the individual modules of signs, such as those used for displaying time and/or temperature data, information signs along major highways and streets giving traffic information or directions, etc., have commonly beem made up by mounting rows and/or columns of electric lamps, to be lighted up selectively as the information to be displayed changes. Such lamps, usually incandescent light bulbs, are often selectively lighted by complex and remotely controlled switching means to display in each module a particular symbol, such as a letter of the alphabet or an arabic numeral. The composite sign, consisting of multiple modules, is lighted up by activating the appropriate elements in all the modules, all that are needed, to display the desired information.

As a rule, in signs of this general nature, the elements in each module usually are arranged so that any one, but only one, discrete character or symbol may be displayed by that module. Hence it requires as many modules as there are characters to be displayed in a typical prior art sign. One aspect of the present invention is the arrangement of elements in a module so that, if desired, more than one symbol or character, or component of information may be displayed by a single module, although in many applications, each module may be used to display only one character or symbol. In certain other applications, a single character or symbol may be displayed by a plurality of adjoining modules.

By thus activating selected elements in the various modules, the information may be changed from time to time, as needed, both in the prior art devices and in the present invention.

Some signs do not include self-lighted elements, such as incandescent lamps, but may depend on reflection of light from external sources to display the desired information. Such external sources may be sunlight, artificial light from various locations, such as from the headlights of automobiles on a highway, etc., as is well known. It has been proposed in the past to mount rotatable or otherwise shiftable parts in the modules, so that a relatively visible face or surface, one that is luminous by the above definition, can be displayed or, alternatively, to show the non-luminous reverse face or surface so as to in effect black out that particular element or blend it into the background so that it is not noticeable. With energy shortages existing and threatened, there is much need to conserve electric power and such usage of reflective elements and components to replace incandescent lamps and the like is bound to increase. Numerous proposals have been made in recent years for using shiftable elements in signs, so that one face or surface of an element is visible or "luminous" and another is relatively invisible or "non-luminous". Selectively turning or shifting of the component which bears these faces or aspects has been provided for by earlier investigators. For example, a recent publication (Feb., 1975) by *Finnan Engineered Products,* of Scarsborough, Ontario, Canada, and "Time-O-Matic", of Danville, Ill., described modules made up of rotatable discs each having a bright or visible face and a dark, relatively invisible face, to be shifted by remote control, using "solid state electronics". The present invention, and that described in the parent copending application, mentioned above, is similar in some respects. Other and related proposals have been made, e.g., in the *Christian Science Monitor,* Apr. 19, 1973, which mentioned rotatable visual elements that are shifted by computer control to present relatively visible and invisible or luminous and non-luminous aspects. See also, "Signs of the Times," Oct. 1974, pp. 48–50.

Parent application, Ser. No. 576,127, mentioned above, now U.S. Pat. No. 4,006,476 describes a display system wherein plural modules are set up to form a composite sign. Each module is made up of rotatable, reversible elements, operated electromagnetically, to display selectively a highly visible side or face and a relatively invisible or background blending face. The application describes the use of simple, easily controlled and actuated electromagnetic means to shift the rotatable elements from one aspect to the other. Similar means are a part of the present invention but the present case goes farther in providing for substitution of self-lighted components for the reflective type when needed, as frequently is the case. Thus, an important feature of the present invention is the means and method by which a sign may be easily and rapidly converted from a reflective type to an incandescent or self-lighted type and vice versa, with minimal extra parts, securing means, conductors, etc.

Another important object of the present invention is to adapt it to convenient and effective remote control, whether self lighted or reflective light elements are used, with low consumption of electric power, by reason of the manner in which the movable parts, or the lights, are energized. Design of the circuitry and the elements that comprise the power circuit is one aspect of this objective. Prior art devices of the general types mentioned above, so far as information about them is available to the present inventor, apparently are controlled by relatively complex means and the component parts used are relatively much more costly.

The present invention includes a number of other features not found in the prior art and offers many advantages, including simplicity and interchangeability of parts, compactness of assembly, versatility of relatively few mounting parts, especially fastening means, for various functions, and the combining of multiple functions in some of these components. A strong, rigid sign structure is obtained, capable of easy and rapid assembly. The display elements themselves are readily transformed from self-luminous to reflective types or vice versa, making it possible to use external light sources to a maximum while permitting easy conversion to self-lighting when needed. Using a base supporting structure, large components embodying a group of modules in each are assembled to form a continuous or essentially continuous surface, usually arranged in a display plane but adabtable to curved, double curved or other display areas. Each module has its own base and its own circuitry, preferably a printed circuit. Each element has its own housing, made preferably in two identical and interchangeable parts. The larger, multiple module units, which may be called sub-assemblies, have also their own base and/or circuitry, preferably printed circuits also, and still larger units, made up of groups of sub-assemblies, may readily be composed, for the largest display systems, using the same or similar connecting, fastening and current-conducting components which, to a large degree are interchangeable and multifunctional. Some of the components have novelty in themselves and are designed to be adaptable to various uses, not only in the present system but in other apparatus of various kinds. These are another aspect of the present invention.

In its method aspects, the invention comprises a method of displaying information over a generally continuous display area by arranging in modules pluralities or groups of individually convertible elements in rows and/or in columns which may be either self-lighted or lighted by reflected light from other sources and which may, in either case, be selectively and individually turned on or off, either by switching electric current on or off or by switching the position of the element itself from active or luminous to inactive or non-luminous position. The modules, in turn, are also arranged in groups, which may be either rows or columns, or both, in contiguous or essentially contiguous relationship, to give a generally continuous display surface over larger areas. The individual modules, through their own local or satellite, circuitry (printed circuit, preferably) are directly connected to a master circuit through means which simultaneously provide appropriate spacing between the local circuitry of the module and the more general circuitry of the master board or circuit. The latter, in turn, may be connected to a still more general power and control system for larger area displays, using similar components, as already suggested.

Further aspects of the invention, along with particular advantages and special objectives that are obtained, will appear from the detailed description which follows.

16, wherein a display element is mounted in a module and including also an optional accessory part.

Figure 18:
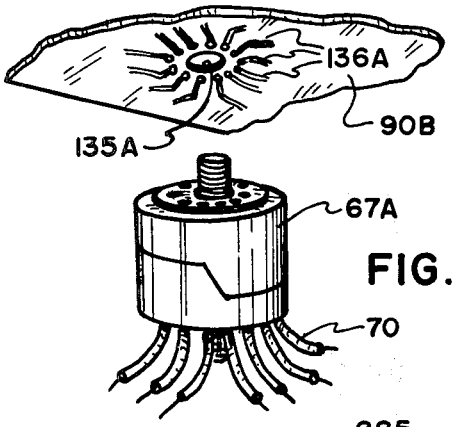

FIG. 18 is an exploded view in perspective, showing a modified means and method for establishing and maintaining electrical contact between major or external wiring components and the conductive elements of a printed circuit panel or an analogous control board on a module or on a sub-assembly.

Figure 19:
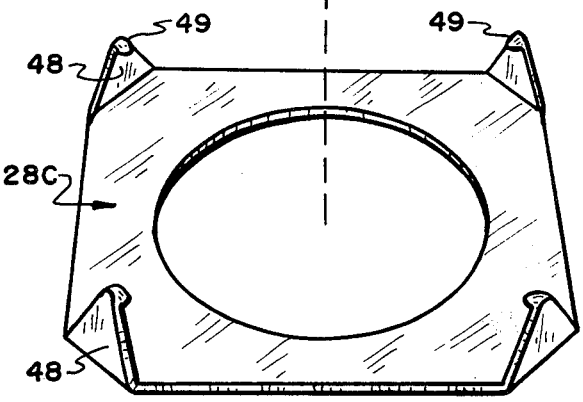
Figure 19:
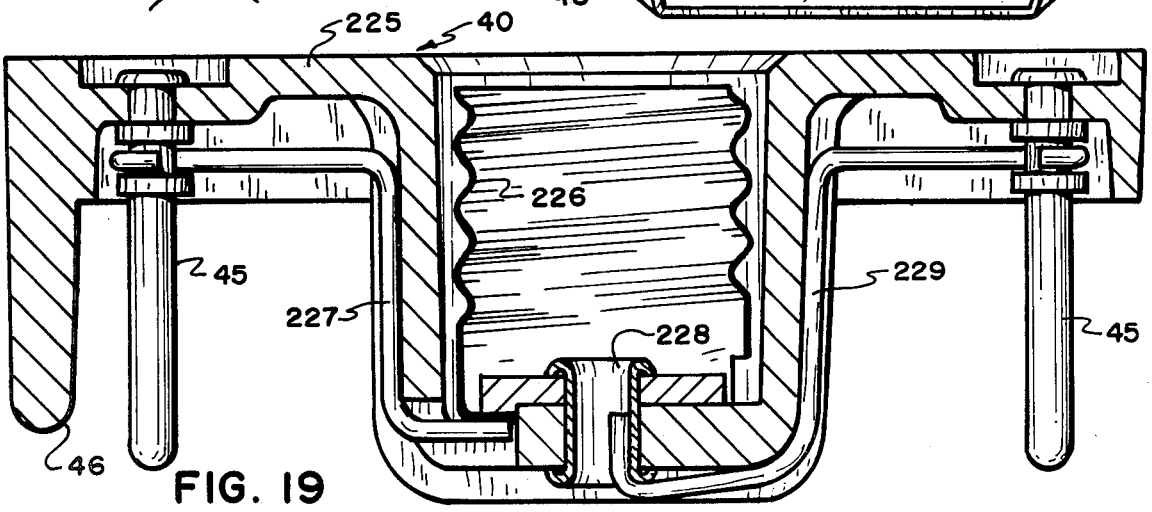

FIG. 19 is an enlarged sectional view showing certain component details in a base support for a self-illuminated display element.

Figure 20:
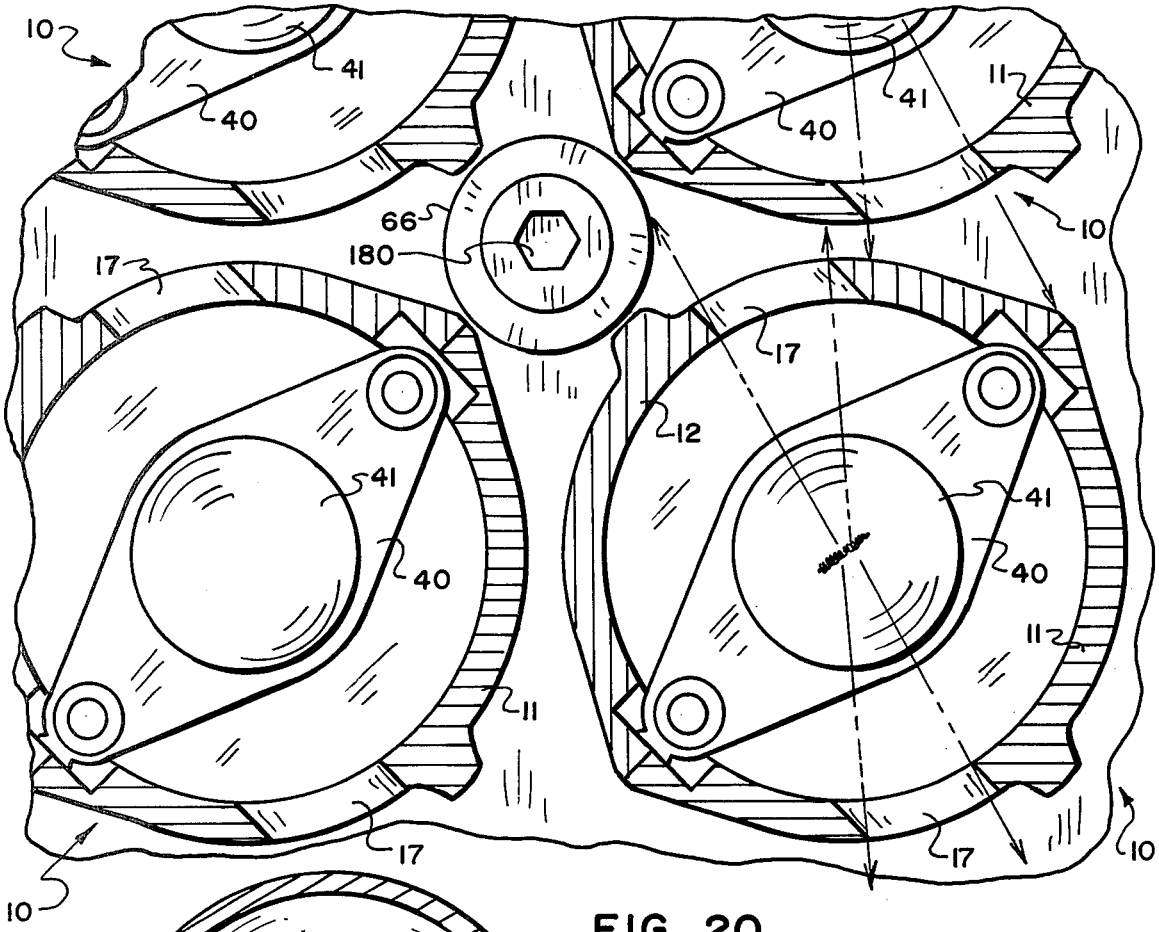

FIG. 20 is a face view, considerably enlarged, with certain parts shown in section and only fragmentary, illustrating certain relationships between display elements mounted in a group and means for fastening them to a base.

Figure 21:
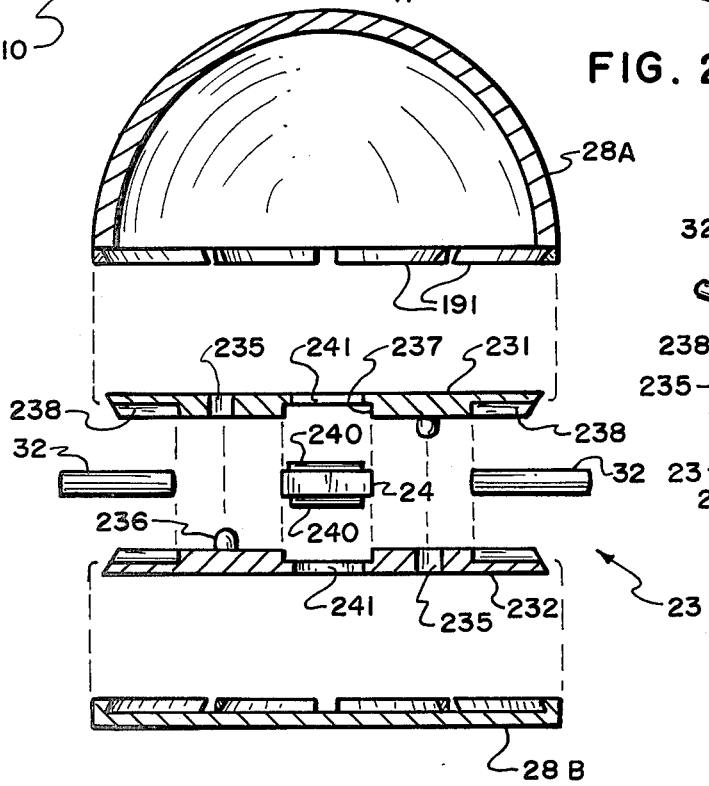

FIG. 21 is an exploded view, largely in section and on an enlarged scale, of a rotatable or reversible rotator component in a reflective type display element, together with certain optional accessory parts.

Figure 22:
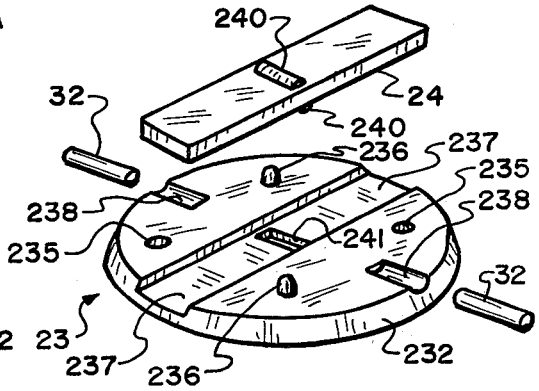

FIG. 22 is an exploded, perspective detail view of some of the parts of FIG. 21, illustrating certain relationships between a permanent magnet element in a rotator and associated parts.

DESCRIPTION OF PREFERRED EMBODIMENT

Figure 1:
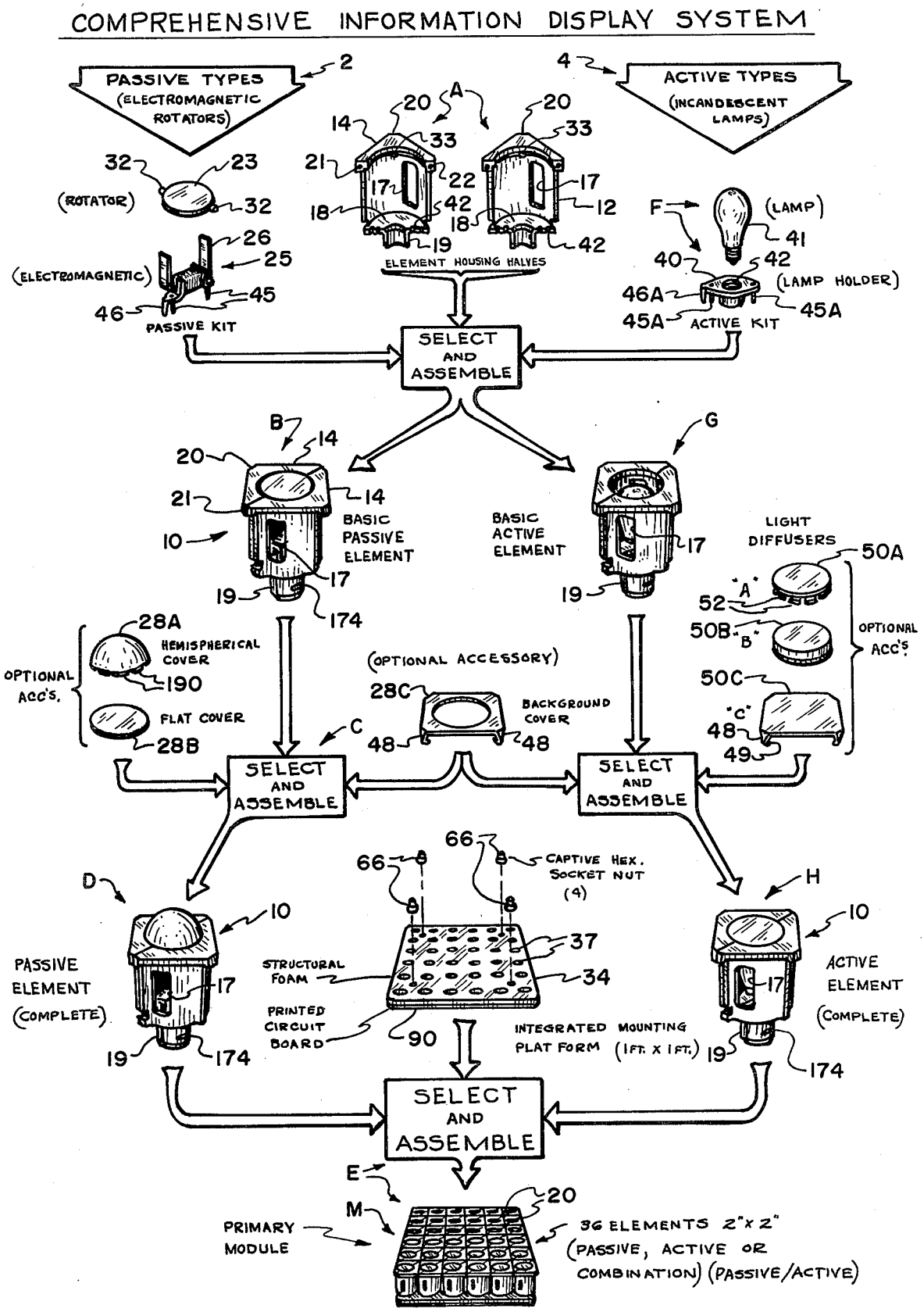
FIG. 1 is a diagrammatic view, including exploded sub-views, showing alternative components and the general method by which they are brought together to make up a comprehensive display system.

FIG. 1 shows diagrammatically a group of parts, some of them being alternatives, and a general method of assembly of minor and major parts, including some major elements and lesser parts that may be chosen and incorporated selectively into a display system, according to the present invention.

At the top of FIG. 1 there are indicated two general alternative procedures, at 2 and 4, the former at the upper left pertaining to a rotator or reversible reflective type element, referred to herein as passive, and the latter, at the upper right, pertaining to a lighted or active element. Basic elements 10 are the elemental building blocks for the system; a housing or shell enclosure, designated A, is shown at the top of FIG. 1 as made up of two identical parts or half shells 11 and 12. Each half shell is in the general form of a hollow half-cylinder having essentially plane ends. The front or upper plane end face part 14 is cut out in the center to receive a circular disc-shaped rotator element 23 which will be further described. The surface 14 will lie in the general display plane or surface (which as a whole may be non-planar if desired) and the outer peripheral edges of the end part 14 form two sides of a square having a small corner cut off. The assembled shell halves thus present an essentially square plane face. Minor corners are cut off at 20 to provide an access opening to certain fastening elements, as will later be described. Each half-shell or half-housing has a window opening in its semi-cylindrical side wall, as shown at 17, for allowing air to circulate by convection and thus assist in keeping the structure cool by dissipating heat. The rear or lower part of the housing, as seen in FIG. 1, is substantially closed by a transverse and generally planar wall 18, except for a central opening from which extends a neck part 19 that is useful for mounting the element in a base support panel.

When a group of four elements 10 are assembled in contiguous relationship, as seen in FIG. 20, to be described more particularly, the cut-off corners 20 provide a small square opening in the composite face of the module, as shown at 200.

Each half-shell 11 or 12 is provided with a hole 33 which serves as a bearing to receive a shaft or pintle end 32 of a rotator 23. These pintles provide for mounting the rotator 23 for free rotation about their axes, except to the extent that the rotator may be restrained against rotation by magnetic forces. Rotator 23 is a composite structure, as will be further described, including a permanent magnet 24, FIGS. 21 and 22, which cooperates with an electromagnet 25, shown at the upper left of FIG. 1. This electromagnet comprises a U-shaped core 26 of soft iron or other magnetically permeable material wound with a coil of electric wire 27, the ends of the winding being attached to contact terminals 45 adapted to be connected to an electrical power supply, explained further below. Half holes 42 are provided in the bottom wall parts 18 of the half-housings to accommodate these contact terminals. A polarizing pin 46 is provided to assure proper polarity of the electromagnet with respect to its power source.

Each of the two half shells 11 and 12 is provided with a projecting pin 21, shown at the upper left of the housing parts, and a cooperative opening 22 at the right, so that when two half shells are assembled they will be held in alignment. The two parts may also be secured together at corners or joints along the sides by using a piece of adhesive tape 29, placed in a shallow recess therefor, as in FIG. 11. This taping is a convenience and is not always essential because the parts are firmly held together by other shells when they are assembled in the module.

The opposite faces of the rotator 23 normally will be differently and distinctly colored or coated to provide an effective and highly visible surface on one side and one that is relatively invisible or blending with the background, on the other. That is, when the element or component 23 has its reflector face forward it is luminous, in the sense already explained, whereas when reversed its other face will blend into the background and be essentially invisible. Auxiliary or accessory parts, readily attachable or detachable, are provided to enhance or alter these effects to give variety to the display. Thus a hemispherical part 28A, of highly reflective material or face coating and of distinctive color, brightness, reflectiveness, or the like, may be fastened easily and securely to the front face of rotator 23, at station C, FIG. 1, using resilient clips or fingers 190 formed around its peripheral edge; see also FIG. 21. Also, or alternatively, a flat disc or cover 28B may be secured to the rear or background-blending face of the rotator to change its color or other visual characteristics. Additionally, or alternatively, a surrounding or background hiding member 28C may be provided to cover that part of the background that is normally visible between the faces of the elements or components 23. Such a device, as shown more fully in FIG. 17, has a central hole to expose all of the face of disc 23, or of accessories applied thereto, conforming otherwise to the outer face of an element 10, with turned-down (up in FIG. 17) tabs 48 which terminate in turned-in hook elements 49. The latter catch under corners of the front flanges 14, through the openings 200, to hold the surrounding member in place.

An assembled reflective element is shown at station B, FIG. 1. With the electromagnet unit 25 installed, and a rotator 23 in place, with or without cover accessories, the element 10, along with 35 other and similar elements is brought to station D, the selection of parts taking place at station C. These are attached to a sub-base panel or backing plate 34, formed preferably of structural plastic foam which is very light in weight but has adequate strength. Plate 34, at station E, is provided with 36 openings 37 to receive the neck portions 19 of the element shells 11 and 12. To the rear face of backing plate 34 there may be secured a printed circuit board or panel 90, to distribute electric current to the various elements 10 which make up the module. The fully assembled module M is shown at station E. The front faces of these elements, surface of front flanges 14, lie essentially in the same plane and form a continuous surface, except for the minor openings 200 mentioned above.

Figure 11:
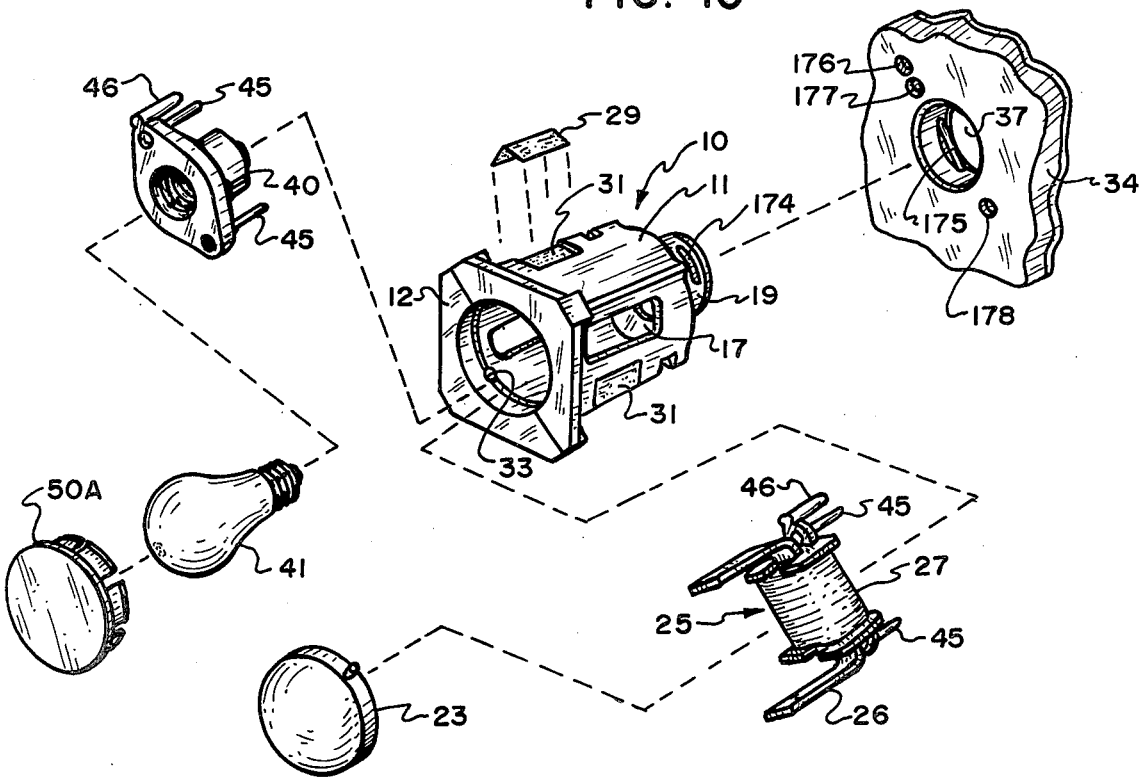
FIG. 11 is an exploded view in perspective, showing alternative methods of assembly of certain element components, with provision for either self-illuminating or reflective type luminous components in a single element.

When it is desired to provide module M with self-lighting elements, such as incandescent lamps 41, shown at station F, upper right of FIG. 1, the procedure under reference character 4 is used. A base 40 for such lamps has a socket 42 to receive the lamp bulb 41 and contact pins 45A are connected to the socket and to the base contact in the conventional manner. An additional polarizing pin 46A is provided in the lamp base, as in the electromagnet unit, to insure installation with proper polarity. FIG. 11 shows further details and will be discussed more fully below.

Figure 17:
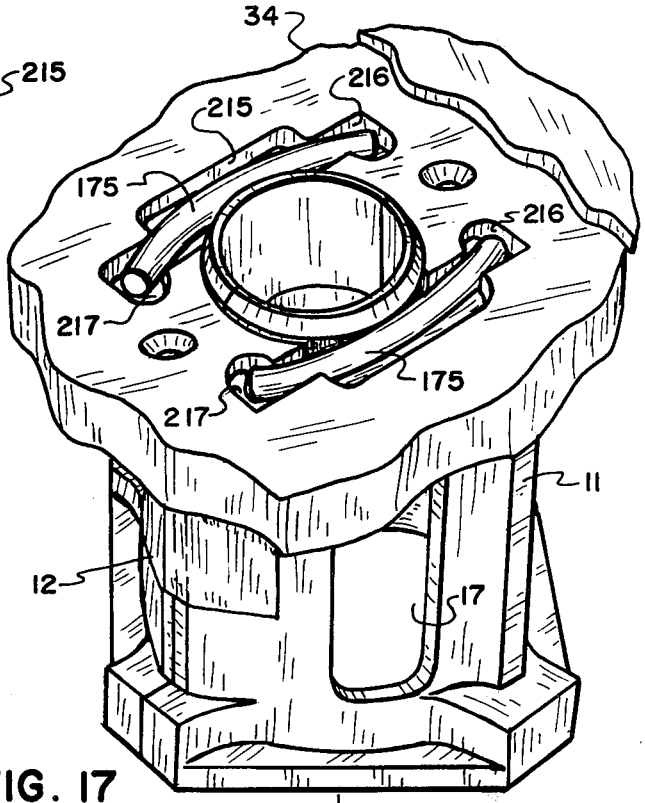
FIG. 17 is an exploded fragmentary perspective view of an assembled element, with some parts shown partly in section, including the retention means shown in FIG.

The lamp and base shown at F, FIG. 1, together with the housing parts 11 and 12 from station A, are brought to station G and on to an assembly point, station H. Here a background masking accessory 28C may be added, if desired, and translucent accessories in the form of light diffusers 50A or 50B may be placed over the lights 41 to change the color or otherwise to modify the transmitted light from the bulbs 41. Accessory 50A may be attached by its depending resilient fingers 52 which engage a groove 51 inside the half housing parts, as better seen in FIG. 12. Instead of using these fastening parts, the cover may have a turned-in lower rim, as in the case of accessory 50B, which will engage in the groove 51, the accessory being put in place before the two half housings are brought together. After assembly, it is firmly and securely held and cannot be removed without separating the two half housing parts. These light diffusers may be used to provide variations in lighting colors, as distinguished from the normal color or appearance of the bulbs 41 themselves. In lieu of either member 50A or 50B, it may be preferred to use member 50C which, like parts 28C, covers the front face and is secured at the corners of the elements in the same manner. The tabs 48 have prongs 49 inturned as shown in FIG. 17, to engage under the front flanges of the housing parts. An assembled module with a light diffuser of the type of 50A or 50B is shown at station H, FIG. 1. Thereafter the element and others like it will be assembled at station E, as in the case previously described.

It will now be understood that by following the route at the left of FIG. 1, there are assembled in a module M a set of elements 10 which are all of the reflective type, each embodying a rotator 23, with or without accessories, such as parts 28A, 28B and/or 28C. On the other hand, by following the route at the right of FIG. 1, the elements assembled will all have self-illuminating incandescent lights within them. Of course, if desired, these parts could be mixed together, some of reflective type and others self-lighted. Ordinarily, this would not appear to be desirable.

Figure 2:
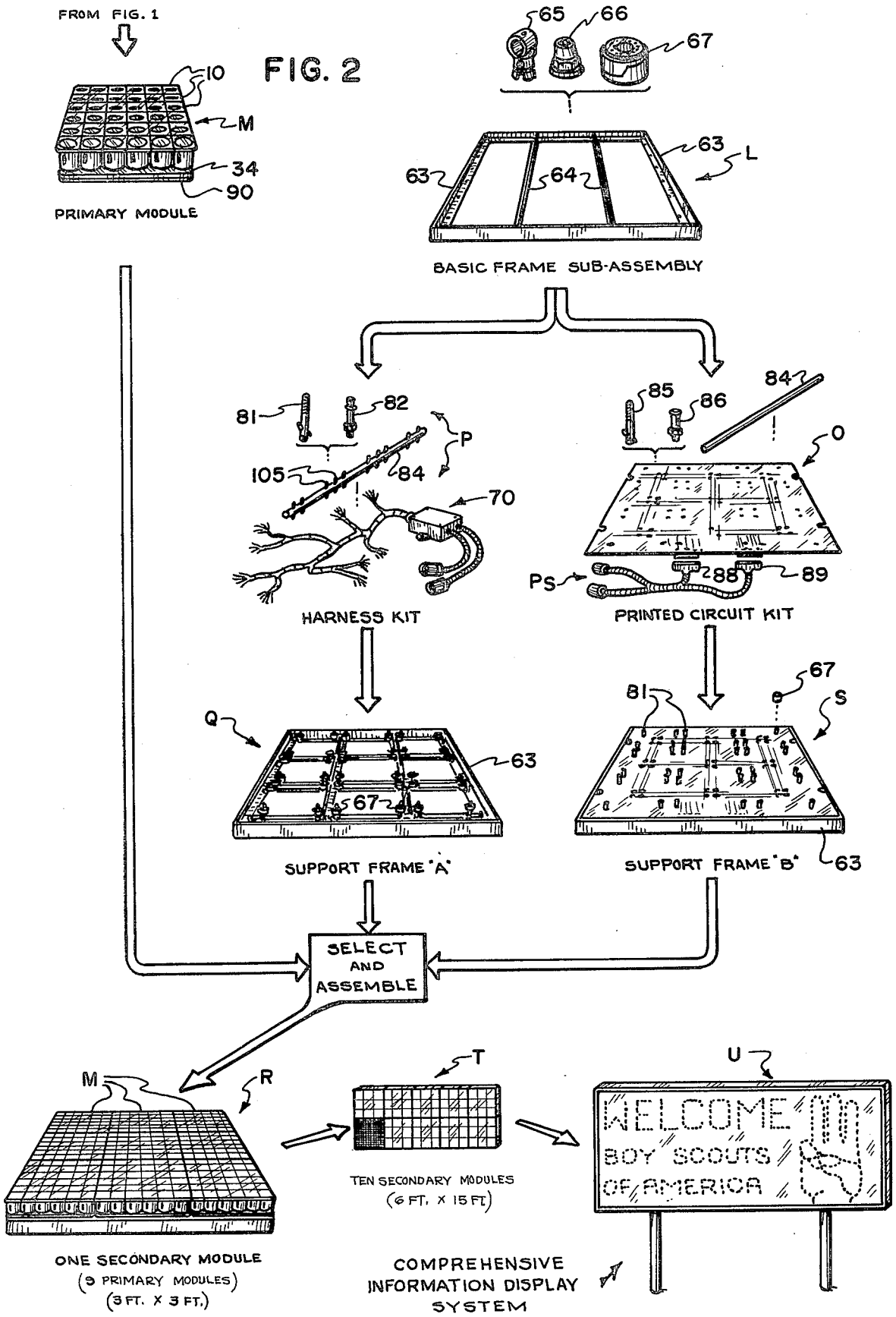
FIG. 2 is another diagrammatic and exploded view, showing further parts and components and the method of their assembly, particularly the assembly of modules into larger groups.

FIG. 2 shows further steps and components in the assembly. Here, individual modules M, nine in number as shown in this Figure, are brought together and mounted on a support sub-frame, made up of surrounding angle pieces 63 and partition pieces 64, as seen at L, top right of FIG. 2. Above the sub-frame are shown three parts 65, 66 and 67, which are of considerable importance and will be discussed further below. Member 65 is a bifurcate hinged connector formed of tough resilient synthetic resin, such as nylon or Delrin, described and claimed in U.S. Pat. No. 3,633,250, issued to the present inventor on Jan. 11, 1972. Further modifications and applications of these bifurcate connectors are described and claimed in U.S. Pat. No. 3,759,398. Member 66 is a plastic nut and spacer device; member 67 is a combination spacer and electrical connector for multiconductor circuits, such as printed circuits supported on panels or the like.

FIG. 2 also shows some screw type fasteners or studs 81 and 82, which are useful in parts of the assembly, as will be explained below, and parts 85 and 86 are useful in other parts. This Figure shows two alternative methods of assembly, one at the left employing harness type electric circuitry components and that at the right employing printed circuitry on panels. In some cases, aspects of both may be used.

Starting with the module M, at the upper left of FIG. 2, a frame L is brought down, along with the necessary number of pre-assembled modules M (nine in the case illustrated), first to assembly position P, where the harness kit is attached, and then to station Q, representing the sub-frame bearing supporting and spacing elements 67 and other securing or connecting parts, ready to receive the modules. The various parts to be secured together are selected and advanced to station R for full assembly.

At the right of FIG. 2, alternatively, a master control panel bearing printed circuitry is shown at 80, the printed circuit elements being on the upper face of this panel. The panel also bears upstanding studs 81, as shown at station S and certain other parts, these having been assembled above at station O. Also, at station O, a control wiring kit, labeled PS and bearing major multi-terminal parts 88 and 89, is shown. The parts grouped at O are advanced to station S where they are readied for the final assembly at R.

Instead of assembling the modules in groups of nine, that is, three by three, it may be preferred to assemble in other groups, such as the two by five (ten modules) grouping at T, FIG. 2, or in much larger and more complex groupings as shown at station U. The latter represents a comprehensive display system of ultimate type and may be as large and complex as desired. For simplicity of description, most of the discussion in this specification will be limited to description of the six by six groupings of elements in a module and three by three modules grouped in a base or sub-frame. For larger units, multiple sub-frames may be assembled to make the display as comprehensive as desired.

Figure 3:
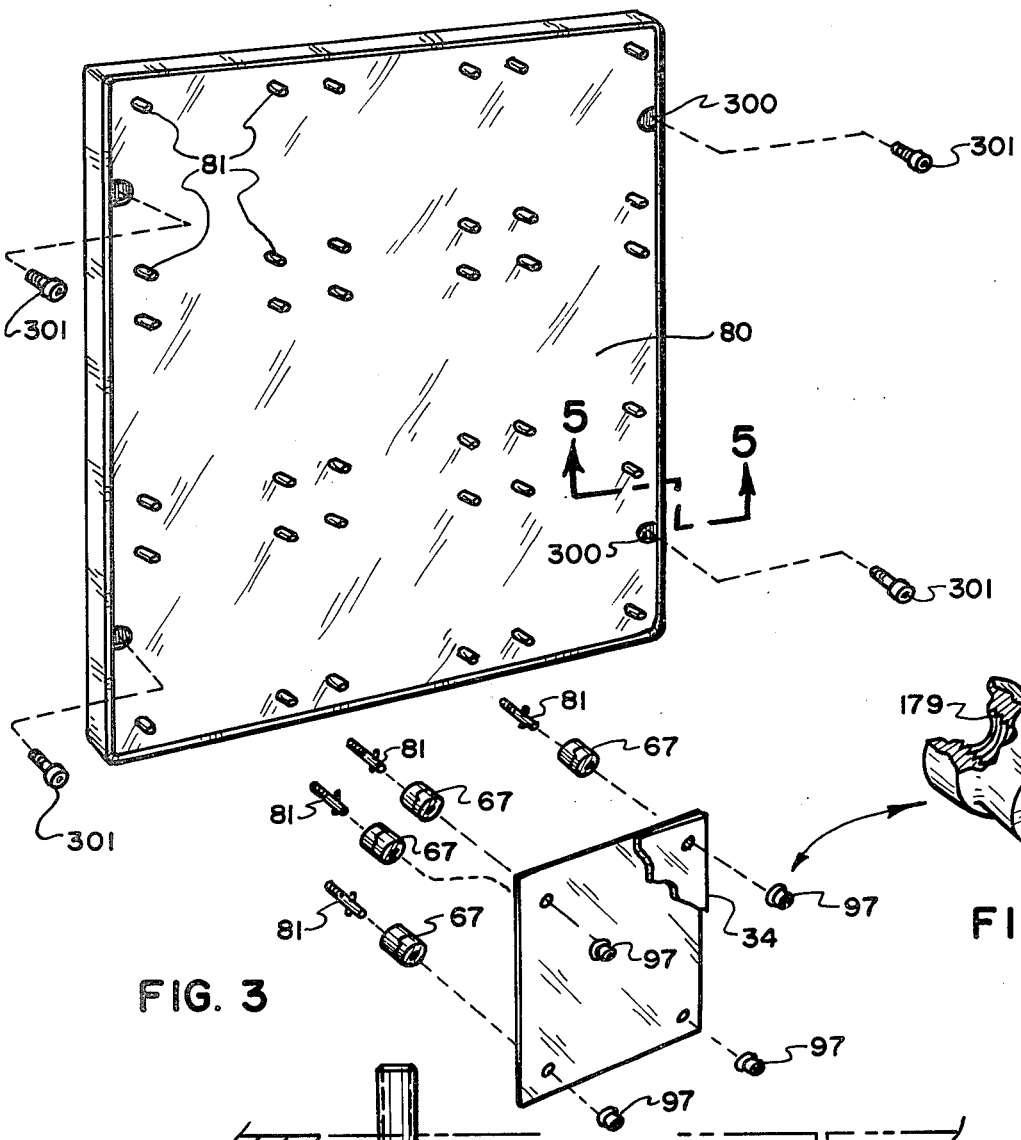
FIG. 3 is an exploded view and a diagrammatic perspective of the reverse side of a panel of multiple modules assembled contiguously on a sub-frame.
Figure 4:
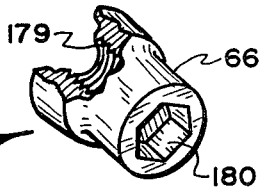
FIG. 4 is a detail view of a fastening element used in the assembly of FIGS. 2 and 3.
Figure 5:
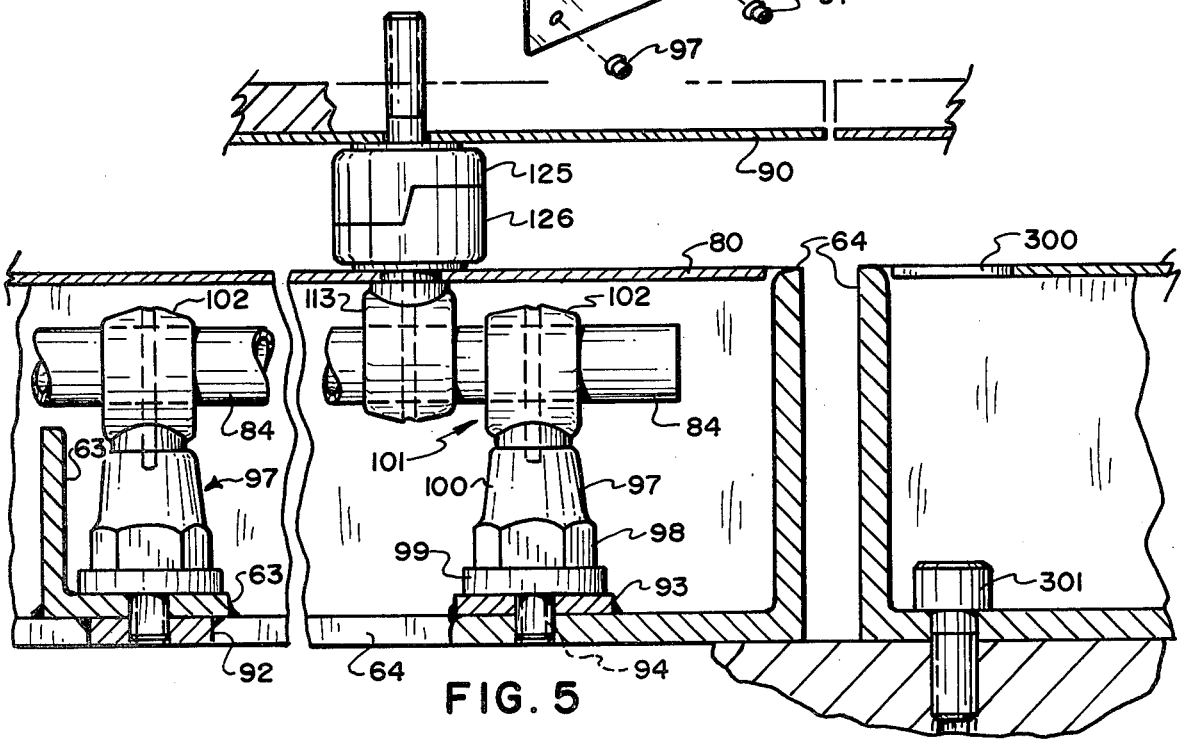
FIG. 5 is a fragmentary view, partly in section, showing fastening means and a method of assembling modules into larger units and showing the structure of various component parts used to support modules and/or groups of modules on a base structure, this view being taken substantially along the line 5—5 of FIG. 3.

FIGS. 3, 4 and 5 show some important assembly steps and parts, as presently preferred for mounting nine modules of 36 elements each in a sub-frame, with appropriate electrical connections. The front of a sub-frame L, or 63, 64, bearing above it a master printed circuit panel 80, is shown in FIG. 3. A number of fastening elements or components, as well as spacers, contactors, etc., are shown, some of them in panel 80, and others projected in front of it. For each module M to be assembled on panel 80, there are provided four studs 81 and four spacer-connector units 67. These were shown on a small scale in FIG. 2 but will be described in detail in connection with FIGS. 3, 4 and 5. Additional fastening components or parts also will be shown and explained.

Referring to FIG. 5, an element 64 of a frame L bears nuts 92 and 93, welded or otherwise secured in place, to provide better thread life than the relatively soft frame per se, the latter being preferably being made of a light metal such as aluminum. Nuts 92 and 93 are of steel or other durable metal. At the lower left, the nut 92 is shown on the bottom of sub-frame element 63; at the lower right the nut 93 is shown on top of the web of a member 64. Either arrangement may be used, as will be obvious.

Figure 6:
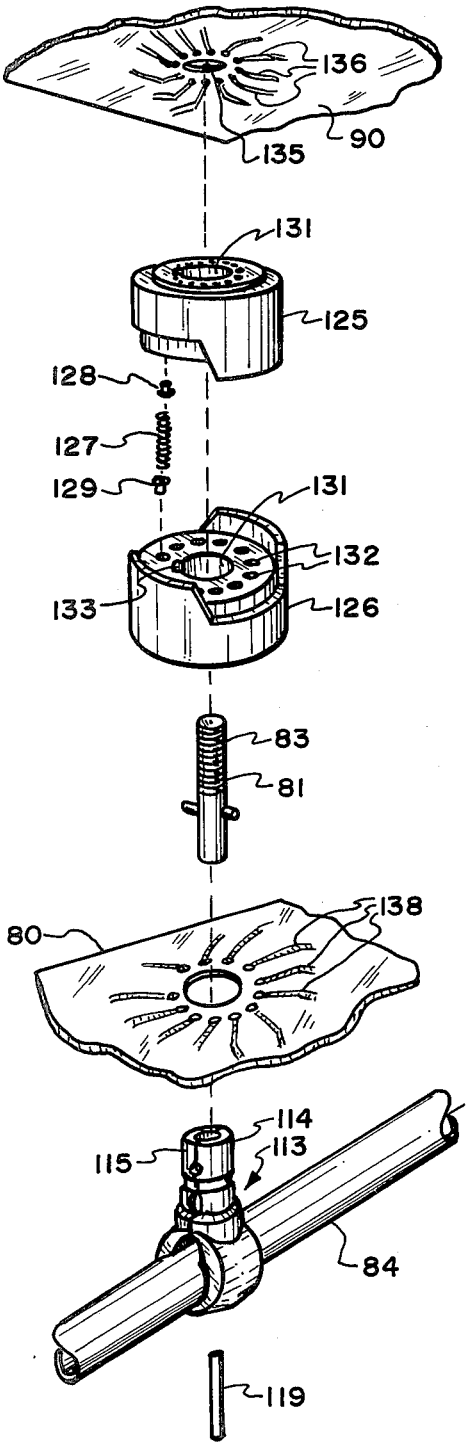
FIG. 6 is another exploded view, diagrammatic and in perspective, showing the relationship between circuit control components and the method and means by which certain of these parts and electrical components are secured together and connected electrically.

FIG. 6 shows at its lower right a stud 86 having a threaded lower end 94, an intermediate hexagonal nut or flange 95 to receive a wrench or other turning tool, and a small upper flange 110. A plastic nut or spacer member 97 is formed with an internal axial hole of hexagonal cross section, as shown at 96. The opening 96 is sized to receive snugly the nut-portion 95 so that when part 97 is turned, the stud 86 must turn with it, to screw the threaded part 94 into or out of one of the nuts 92 or 93. Hole 96 also is of the right size to receive snugly the two legs of a bifurcate connector 101 which has its flexible loop portion 102 engaging around a rod or tube 84. Rods or tubes 84 form part of the interconnecting structure as shown in FIG. 5. Some of these parts are shown also in small scale in FIG. 2. Nut member 97 has a bottom flange 99 below its hexagonal part 98 and its upper part is somewhat tapered as shown at 100.

The top end of stud 86 has a small hole or axial bore 104 to receive a pin 105 which may pass through rod or tube 84 to prevent relative rotation between it and the bifurcate connector 101 and/or the stud 86. An opening 106 is provided in the loop part 102 of connector 101 to receive this pin 105.

Because of the flexible nature of the loop portion 102, the legs 108 and 109 of connector 101 may be separated enough to permit them to receive between them the relative larger top end flange 110 of stud 86. They are provided with an internal annular groove 111 which will receive this flange 110 and permit the legs to be closed together. When thus closed, and held in closed position by a confining member such as nut 97, the legs firmly hold the stud 86 against axial movement. As the parts are shown assembled in FIG. 5, then, the screw threaded part of stud 86 engages nut 93 in the frame, bifurcate member 101 holds the upper end of this stud, and its loop part is tightly wrapped around rod or tube 84, the legs are snugly engaged around the flanged stud end 110 while also snugly encompassed by the hexagonal hole in the nut 97, these three parts are firmly locked together and pin 105 prevents rotation of the rod or tube 84 in loop 102. Thus the part 84 is firmly secured to the frame member 64. As also shown in FIG. 5, an opening 300 in panel 90 affords access by a tool to a major mounting screw 301.

Figure 8:
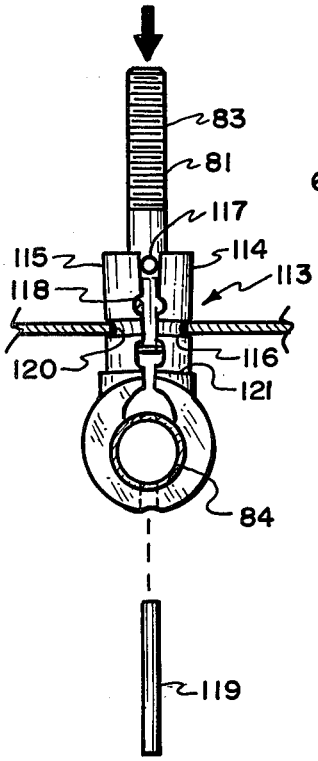
FIG. 8 is a detail view, partly in section, showing component details and a method of assembling certain fastening devices to secure major structural and/or electrical parts of a display system together.

Another bifurcate connector also with its loop flexible enough to hinge open, is shown at 113 with its bifurcate legs 114 and 115 directed upwardly, FIGS. 5, 6 and 8. Referring particularly to FIG. 6, it will be seen that the legs 114 and 115 are designed to snugly engage the stud 81 which is threaded at its upper end and has a cross pin 117 in its lower mid portion, arranged so that one end of the pin projects somewhat farther from the stud on one side than on the other. The bifurcate legs 114 and 115 are notched at 118 to receive this pin when they are closed together. When not confined, they can spread far enough apart that the stud 81 with cross pin 117 can be pushed down between them, the legs being formed to snugly engage stud 81 when closed together and the bifurcate member being formed to snugly engage the shaft or tube 84 when the legs are closed. The same is true of bifurcate member 101 and shaft 84. As in the case of the stud 86 and bifurcate member 101, a pin 119, FIG. 8, may be inserted from the bottom to prevent the bifurcate member and stud 81 from rotating with respect to rod or tube 84 when the parts are fully assembled.

In assembling, the master circuit board 80, which is provided with holes 116 to receive the resilient legs 114 and 115 of bifurcate member 113 when these legs are closed together, will be placed over member 113 and lowered part way until an annular groove 120 formed in the two legs engages the relatively thin board 80 and permits the legs 114 and 115 to spring apart somewhat, as shown in FIG. 8. This holds the board temporarily while permitting the stud 81 to be inserted into fastener 113 with it cross pin passing between the separated legs 114 and 115, as shown in FIG. 8. When the cross pin 117 reaches the notches 118, the legs can be closed together and then the plate or board 80 can be pushed down the legs and against a flange 121 on the bifurcate member. The legs will be held together by the board, as hole 116 is closely fitted about them, except when groove 120 permits them to separate. The studs 81 are thus trapped by the legs 114 and 115 with their threaded ends 83 projecting upwardly, as seen in FIGS. 6 and 8.

To further hold the legs 114 and 115 together, and at the same time act as spacers between circuit board 80 and 90, and also to provide electrical connections between appropriate conductor elements on the respective boards, there are provided the spacing members 67, mentioned briefly above in connection with FIG. 2. These are made in two identical halves, molded or cast from a suitable non-conductive resinous material, as shown at 125 and 126, FIG. 6, where the two halves are separated and in FIGS. 5 and 7 where the halves are assembled closely together. They are so formed by offsetting the joint between them that they cannot be put together except in predetermined orientation with respect to each other. The reason for this is that each of them is bored around its periphery with a ring or holes 132 to receive small springs 127 and pins 128 and 129 to make contact with appropriate conduct or elements on the two printed circuit board 80 and 90. When assembled, as in FIGS. 5 and 7, the lower pins contact the major board 80 and the upper pins contact the satellite board 90, being urged apart by the small coil springs 127. Each pin has a flange 130 which prevents it being ejected completely from the half spacer 125 or 126, the bores 131 in these parts being smaller at the ends than in the mid-portions of the half spacers, as clearly shown in FIG. 7.

Figure 7:
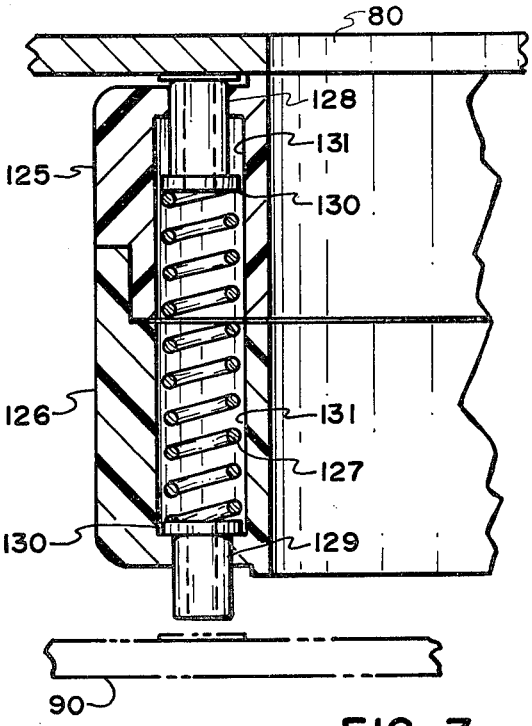
FIG. 7 is an enlarged and fragmentary sectional view of certain circuit connecting and structure spacing components of FIG. 6, illustrating a relationship between the parts when fully assembled.

A central hole 131 through the spacer halves 125 and 126 is sized to receive snugly the legs 114 and 115 of the upper bifurcate connector 113 when they are closed together and thus firmly lock them about the stud 81 with the cross pin 117 engaged in slots or notches 118. The bore or hole 131 is provided with a keyway 133, FIG. 6, in which the longer projecting end of this pin will be received as the spacer 67 is slid onto the closed legs. This orients the members 67 with respect to studs 81 and bifurcate connectors 113 and making sure that the several contacts, such as pins 128 and 129, are aligned opposite the proper circuit elements on circuit boards 80 and 90. The upper ends of the bifurcate legs 114 and 115 are also inserted into an opening 135 in the upper or satellite board 90 while the contacts 128 are pressed upwardly by electrically conductive springs 127 against conductor elements 136 on the under face of this board, as best seen in FIG. 6. Similar conductors 138 on the upper face of the lower or master board 80 are contacted by the lower set of pins 129. In FIG. 7, these parts are inverted and pine 129 are shown out of contact with board 90, indicating that the parts have not been fully closed together.

Figure 6A:
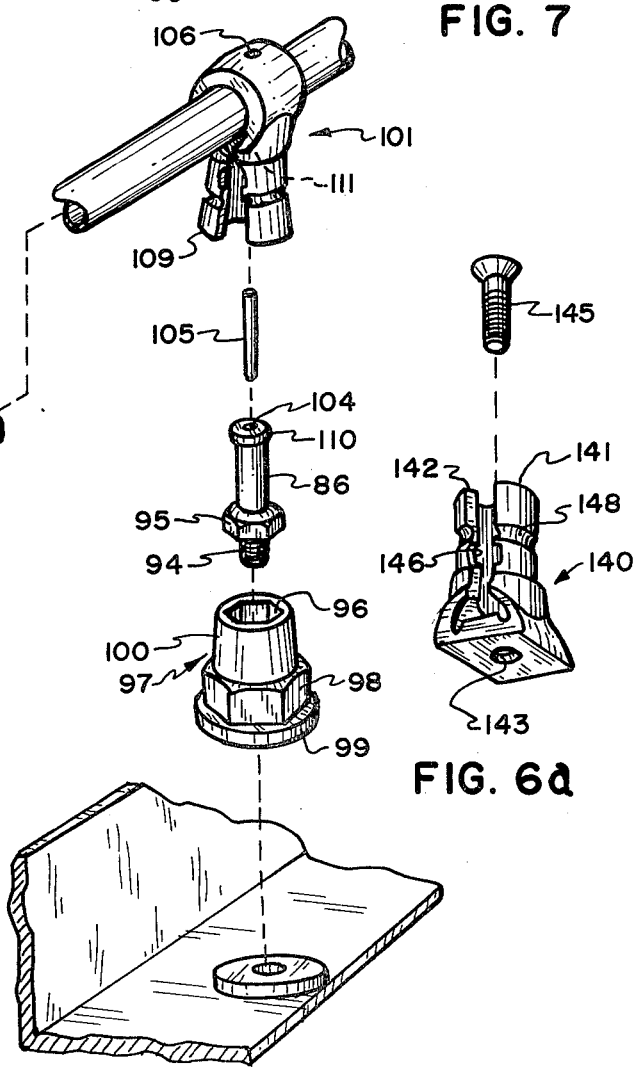
FIG. 6A is a detail view, showing in exploded form and in perspective a modified fastening element which may be used in certain cases as an alternative to some of the fastening means shown in FIGS. 3, 5 and 6.

In FIG. 6A there is shown an alternative type of fastener 140 which in some cases may be used in lieu of the nuts 97 of FIG. 6. This consists of a flat based bifurcate member, having upstanding legs 141 and 142, provided with an opening 143 in its base to receive a screw 145. The latter will be inserted into a nut such as 92 or 93 to hold the parts together. Such a device is particularly useful when, for example, it is desired to mount the satellite board 90 directly on a flat base, as would be the case when the harness kit 70 of FIG. 2 is used, there being no lower or master printed circuit board in this case. Member 140 is provided with notches 146 in its legs to receive a cross pin such as pin 117 in stud 81 and with an external peripheral groove 148 which performs the same or a similar function as groove 120 in bifurcate member 113.

Figure 9:
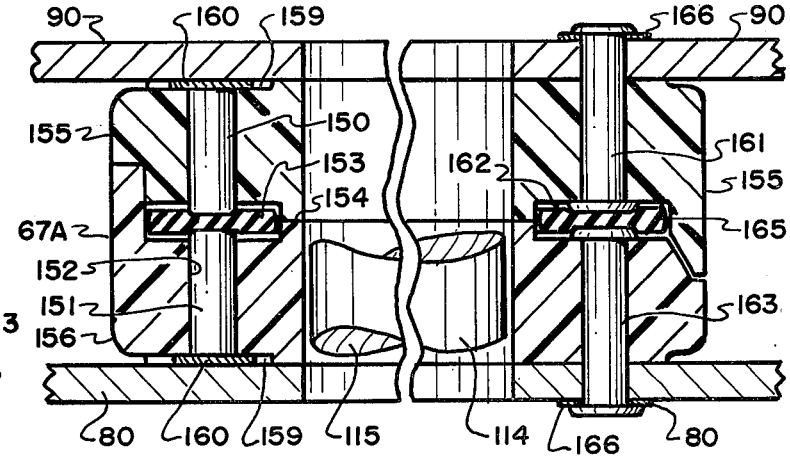
FIG. 9 is a fragmentary and enlarged sectional view of a modified arrangement for holding certain circuitry and structural components together and for providing electrical connections between the circuit parts.

FIG. 9 shows a modification 67A of the member 67 which serves both to space and provide electrical connections between upper and lower elements. Instead of having the spring urged pins 128 and 129, it has, at the left, slidable pins 150 and 151 disposed in a circle outside the center bore 152. At the juncture 154 between upper half 155 and lower half 156, the half members are recessed slightly at 157 around each pin 150 or 151 to receive a small compressible disc of conductive rubber 153. Similarly, at top and bottom, the spacer halves are formed with small recesses 159 around the ends of pins 150 to receive small discs 160 of the same type of resilient but compressible electrically conductive rubber. By these means, when the parts are assembled, contact is made between the conductive elements on the respective lower and upper printed circuit boards 80 and 90.

In the same FIG. 9, at the right, an alternative but equivalent arrangement is shown wherein the upper half 155 of the spacer is riveted through the top or satellite board 90, the lower end of the rivet 161 being received in a recess 162. Similarly, the lower rivet 163 secures the lower half to the lower board 80 or main base in like fashion. A piece of compressible elastic electrically conductive rubber 165 is placed between the ends of the upper and lower rivets to maintain electrical conductivity when the parts are assembled. In this last described arrangement, the upper and lower half spacers 155 and 156 are respectively and permanently attached to the respective circuit boards. Printed conductive elements 166 are shown under the heads of rivets 161 and 163.

Figure 10:
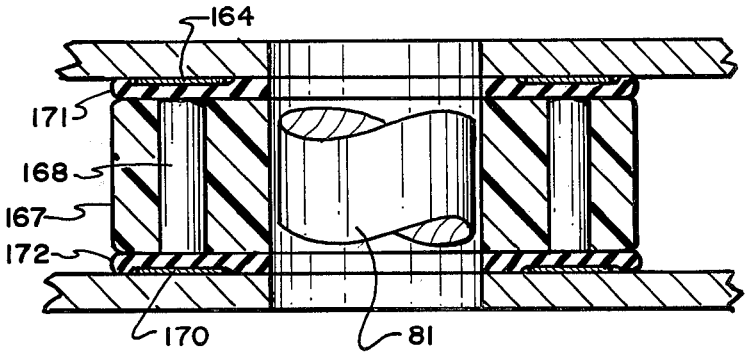
FIG. 10 is a somewhat similar fragmentary view of a somewhat different arrangement alternative to that of FIG. 9.

FIG. 10 shows another modification wherein said, one-piece spacers 167 are used to replace the two-part spacers 67 described above. Here the spacer element 167 is provided with an annular ring of spaced pins 168 of conductive material which abut at upper and lower ends, respectively, against small pieces 164 or 170 of the same type of conductive rubber as mentioned above. These small pieces, separate from each other, in turn press against conductive elements 171 and 172, respectively, of the upper and lower printed circuits, when the parts are assembled as shown. As in the previous examples, the parts are held together by the studs 81 and associated bifurcate parts 114 and 115 already explained in detail.

Figure 15:
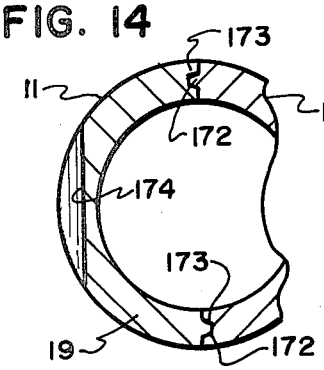
FIG. 15 is a fragmentary detail view, in section, through certain parts shown in FIG. 14, being taken substantially along the line 15—15 of FIG. 14.
Figure 16:
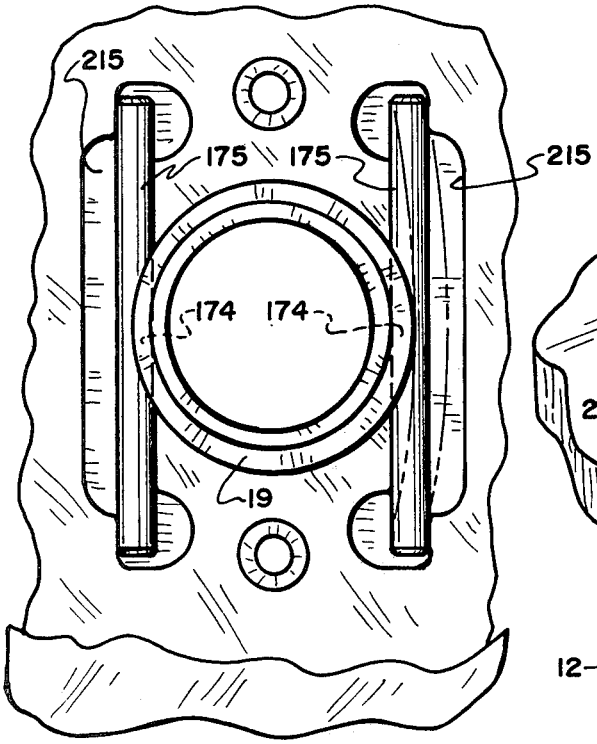
FIG. 16 is an enlarged fragmentary detail view in elevation, showing a method and means for holding an element of either the self-illuminating or the reflective reversible type in the mounting board of a display module.

FIG. 11 shows in exploded or open arrangement, a number of the parts that have already been described, arranged in the alternative for fastening into a structural plate 34. Such a plate was shown in the lower part of FIG. 1 but certain details remain to be explained. As shown in the upper right of FIG. 11, where board 34 is shown only fragmentarily, each of its openings 37 is adapted to receive the neck portion 19 of an element shell or housing 10. The two half shells 11 and 12 are each formed with a rib 172 on one edge and a groove 173 on the opposite edge, FIG. 15, to hold these parts in alignment. A pair of small elastic or resilient struts 175 are mounted in each opening 37 to snap into shallow grooves 174 formed on either side of neck 19. Only one strut 175 and one groove 174 are seen in FIG. 11 but FIGS. 16 and 17 show these parts in more detail. See also FIG. 14. It will be understood that each element 10 includes one or the other of the groups of internal components shown in FIG. 11 as already explained. If the unit is to be an active or self-lighted one, the lamp base 40 with its contact pins 45 and polarization or polarity control pin 46 is used with the pins protruding from the base or rear of the element, as viewed in FIG. 11. A lamp bulb 41, with or without a diffuser 50A may be placed in the element. Alternatively, if the unit is to be of the inactive or reflective light type, the rotator assembly or unit 23 and the electromagnet unit 25 will be assembled within the housing. The electromagnet unit 25 of course includes the iron core 26, the winding 27, contacts 45 and a polarizing pin 46, as mentioned above.

Figure 12:
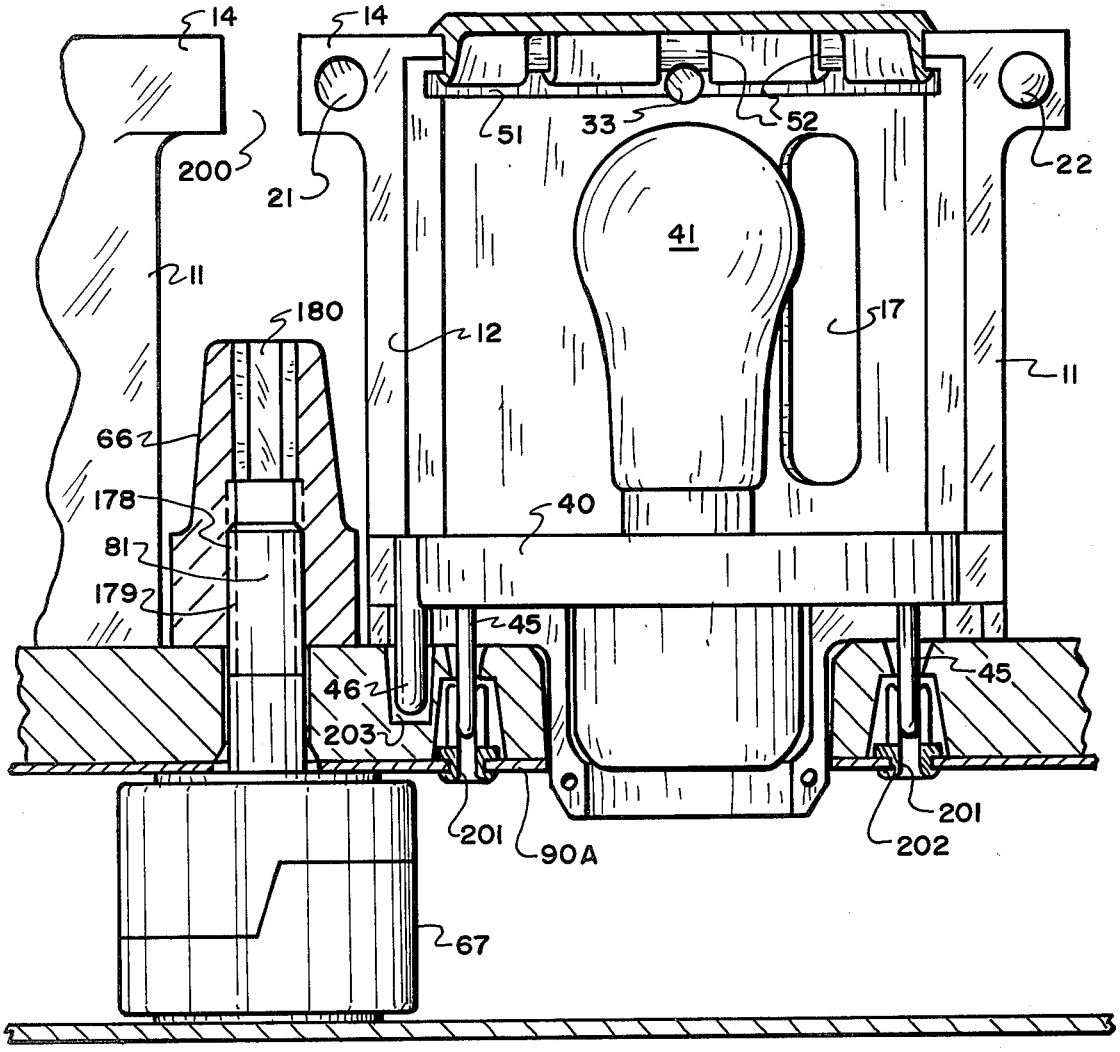
FIG. 12 is an enlarged fragmentary detail view, partly in section, of an assembly of elements with supporting means in a module, including self-illuminating light components.

FIG. 12 shows on a larger scale a number of physically small features which are important in the present invention. Some of them have already been mentioned briefly but further detailed description is needed. Each casing or housing for an element 10 has in its upper parts the aligning pins 21 and holes 22 needed to preserve true alignment between the parts when they are assembled. The internal groove 51 under the top flange receives retaining elements or spring tabs 52 of the accessory parts as already described. A stud 81 is shown at the left for holding parts together, as already explained. Its upper threaded end 178 is adapted to receive a cap screw 66, which has already been mentioned in connection with FIG. 4. The cap screw is threaded internally at 179 to fit threads 178 and has in its upper part a hexagonal opening 180 adapted to receive a hexagonal tool which can be inserted through one of the small square openings 200 formed by cutting off the corners 20 of the flanges 14, FIG. 1.

With four elements 10 fitted together, a nut 66 is held captive between them. It may float around within the cavity formed by the adjacent walls of four adjacent elements 10 until it is reached with a wrench, through opening 200, and screwed onto the stud 81. When this is done, the parts shown separated in FIGS. 3 and 6 are all brought together and held in assembled relationship. For each module there are provided four such studs 81 and nuts 66 to hold the module, with its 36 elements 10 assembled on the base board 34. With the further means shown in the lower part of FIG. 3 and described above, the modules M are further secured to the sub-frame and/or to larger supporting structures. The opening 33 in the upper part of each shell half is adapted to receive the axle or pintle 32 of a rotator but in FIG. 12 there is no rotator shown, an active or self lighted unit 40, 41, etc., being installed instead.

The upper or satellite circuit board 90A, FIG. 12, which is identical with or equivalent to the boards 90 previously mentioned, is provided with female contacts in the form of hollow rivets or sockets 201 fitted in holes 202 in the board. These are placed to receive properly the contact pins 45 of the lamp base 40 in which the incandescent bulb 41 is mounted. The polarizing pin 46 preferably molded as an integral part of lamp base 40, fits into a further hole or socket 203 to preserve proper polarity.

Figure 13:
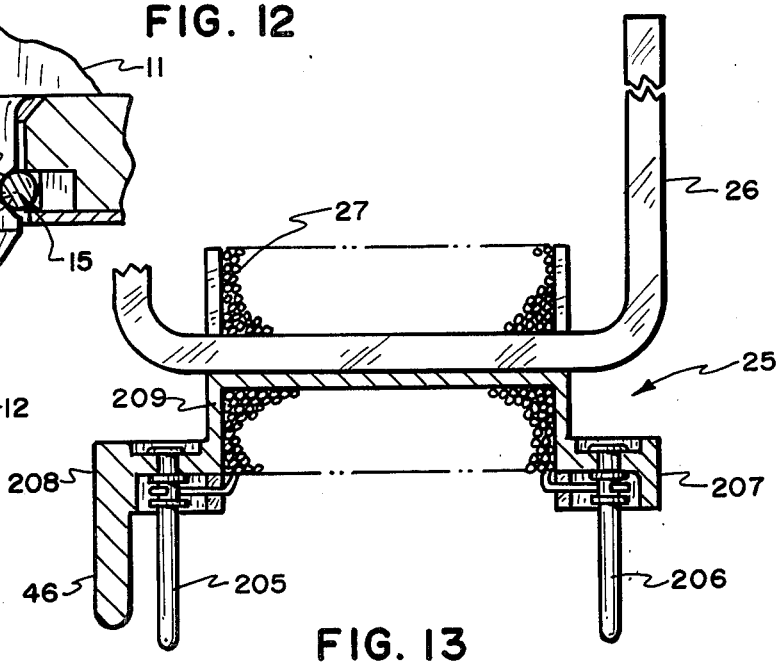
FIG. 13 is a related detail view, largely in section, showing certain electromagnetic parts and associated components suitable for operating reversible reflective display elements.

FIG. 13 shows some details of the electromagnet unit 25 which consists of the U-shaped soft iron core 26 and the coil 27, plus appropriate terminals shown here at 205 and 206, referred to above in FIG. 1 by reference numerals 45. The terminal pins are mounted in molded flanges 207 and 208 of a plastic or other non-conductive spool 209 and are connected appropriately to the coil ends by conductive connections 211 and 212. Here again, the polarizing pin 46 is shown, formed as a unitary extension of the spool 209.

Figure 14:
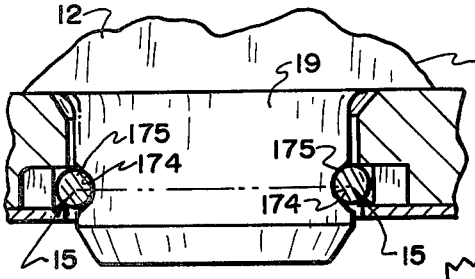
FIG. 14 is a sectional and fragmentary detail view, showing a method and means for retaining basic display elements in a module base, which base also supports a printed circuitry panel.

FIGS. 13, 14, 16 and the upper part of FIG. 17 show further details of the arrangement of the resilient struts 175 which snap into the shallow grooves 174 of the element necks 19, as already mentioned. These struts 175 are made of strong resilient material and normally stand more or less straight as seen in FIG. 16, except when they are deflected to left or right by insertion of a housing neck 19 between them, as in FIG. 17. The boards or structural members 34 are cut out as shown at 215, FIG. 17, to provide clearance areas 216 and 217 in which the ends of struts 175 are received. These areas are wide enough to permit some lateral motion of the strut ends when they are stressed or bent as in FIG. 17. They snap back to a substantially straight position as they spring into grooves 174 on the sides of neck 19. This prevents them from obtaining a permanent set from long continued stress. At the bottom of FIG. 17, a background cover plate or surrounding 28C, of the type already described in connection with FIG. 1, is shown on a larger scale. Its tabs and hooks that hold it in place have already been described.

FIG. 18 shows a modified arrangement wherein the circuitry elements 136A on a satellite board or primary module panel 90B are arranged about an opening 135A (compare the top part of FIG. 6). A spacer element 67A, generally similar to element 67 described above, is arranged to establish electric contact between appropriate elements of a wire harness set 70 (FIG. 2) or the like and the satellite circuitry board which includes the elements 136A and in which the basic elements 10 are mounted. These parts are assembled in the manner already described, using, where appropriate, fasteners of the type shown at 140, FIG. 6*a*.

FIG. 19 is an enlarged sectional view of a lamp base, showing how the parts are mounted in a molded base member 225, formed of insulating material such as moldable or extrudable synthetic resin. It includes a conductive lamp receiving socket 226 which is connected to one of the terminals 45 by a conductor 227; the bottom contact 228 being in the form of a hollow rivet, is connected by a lead 229 to the other terminal 45. These terminals 45, in the form of pins, are secured in the molded base member 225 in suitable fashion, as will be readily understood. Polarizing pin 46 preferably is a unitary extension of the base part 225.

It was mentioned above that openings 17 are provided in the shell halves 11 and 12 to permit circulation of air by convection, thereby to keep the apparatus from heating up from the lamps and other electrical resistance parts. These openings are so arranged, as seen in FIG. 20, that while air may pass freely between the parts, no light will show to the front of the sign or display to interfere with the desired display matter. While the front of the display is essentially in a common plane or other continuous surface, there are small openings 200 in its face and there is considerable space between elements 10 behind the display face. Air can circulate freely but the element housings are so formed that the openings 17 are not in alignment, as shown in FIG. 20. Here four distinct adjacent elements 10 are grouped around a fastener 66 but no light can pass through an opening 17 into an adjacent element 10. The inside surfaces of the shell half members are made smooth and shiny inside to reflect as much light to the front as is possible but lateral transmission through the sign of light from the incandescent lamps is prevented by the arrangement of the openings 17.

FIG. 21 is an exploded view on a large scale and FIG. 22 is a partial perspective view of the rotator 23 and its component parts. As already noted, these include a permanent magnet 24 which is fitted between identical upper and lower molded resin parts to substantially enclose the magnet between them. These parts 231 and 232 are cut away at 237 to receive the magnet; the magnet has small protuberances on its upper and lower faces at 240 and each member 231 and 232 is provided with a small recess 241 to receive the protuberance and thereby firmly and accurately position the magnet within the rotator. The parts 231 and 232 also are provided with two aligning pins 236 and two aligning holes 235 in each part, so that when the parts are assembled, there are four aligning pairs of elements to preserve good alignment between the parts. Each half is provided with a recess 238 having a square and accurately placed end against which the square end of a pintle 32, also accurately formed, may be positioned. Thus the rotator parts are carefully designed to fill the space between arms 26 of the electromagnet 23 without frictional contact with them to minimize air gaps in the magnetic path which comprises the permanent magnet 24 and the electromagnet 25. This, of course, conserves electrical energy in operation. The two half members 231 and 232 may be formed at the outset of different colored materials, one to give good color and luminosity, and the other to reflect as little light as possible or to blend well with the background for contrast. Along with the accessories 28A, 28B and other parts already described, these parts may be chosen and made to produce attractive displays with a wide choice of alternatives and at comparatively low cost.

A hemispherical cap or adapter 28A and a flat disc type rear face cover 28B are shown in FIG. 21. As previously noted, these parts are optional but very useful to give variety to the display.

The details of control mechanism, whereby the various elements and components are activated or inactivated, or shifted from visual to non-visual positions and vice versa, form no part of the present invention. It is contemplated however, that the control means shall be so constructed and operated that it can shift movable parts, such as the rotators 23, or turn lights on and off, in rapid sequence but not simultaneously, to avoid high peak loads and/or arcing at major switching points with consequent deterioration of equipment. Such sequential operations may be programmed by those skilled in the art, but the method of operating is a part of the method aspects of this invention.

It is contemplated also that the various components and accessory parts may be designed for interchangeability and substitution with a minimum of changes, to display different colors, and aspects of the visual elements as well as of the background, as often as may be desirable. In this connection, the term "visual" elements, as used herein, is intended to refer to the parts or elements that define the character or other matter to be displayed, as contrasted with the background. The latter of course may also be visible but, in general, it will be of secondary visibility and may in many cases be almost or entirely invisible, as in the case of incandescent elements shining from a black background at night, etc.

It is contemplated that various types of light and lighting energy may be used. Thus, so-called black light (ultra-violet) and/or fluourescent or phosphorescent elements may be used to impinge on and make visible suitable coated or colored elements to give various effects, as will be well understood by those skilled in the art.

To summarize, the invention contemplates the use of various components, some of them in the alternative, to be assembled and mounted in a simple but efficient manner, using fastening elements that are simple, inexpensive, interchangeable and versatile, so that relatively very few parts and a limited number of kinds of parts are required. Many of those that are used are installed so as to perform multiple functions. As explained above, the bifurcate fastening elements such as 101 and 113 often perform two or even three functions; so also do the spacer sleeves 67, which help to retain the bifurcate members in locked condition while also holding the wired or printed circuit control boards or panels in proper spaced relationship at the same time that they provide electrical intercommunication between the boards or panels. The net result is that a very versatile assembly is provided for while the component parts are kept to a practical minimum in kinds and numbers, and these, in general are relatively very inexpensive. The manner in which the elements can be assembled to form a virtually continuous display surface has novelty and merit, as do the versatile and selectively interchangeable light-producing and color or appearance modifying accessories.

It will be obvious to those skilled in the art that many and various modifications may be made in the means for and the method of assembly and fastening as well as in the larger or more functional components, such as elements and modules themselves, without departing from the spirit and purpose of the invention. While specific numbers and arrangements have been described by way of example, and these are presently favored, it is to be clearly understood that the invention, is in no way limited by such examples, except as the state of the prior art may require. It is intended by the claims which follow, to claim the invention, and to cover its obvious alternatives, modification, substitutions and variations as broadly as the state of the prior art properly permits.

What is claimed is:

1. Apparatus for displaying information over an extensive and generally continuous area which comprises a main base support generally coextensive with said area in combination with:

(a) A group of separate individual modules supported by the base and arranged contiguously to cover said extensive area each of which modules comprising a sub-base support panel and a group of substantially similar elements secured to said base and arranged contiguously to each other so as to cover substantially the full area of the module, (b) A local modular circuitry associated with the sub panel and having an individual connection to each of said elements in a module for selectively activating or deactivating individual elements in said module independent of all other elements and modules, (c) A higher order control circuitry separately mounted on its own panel and having a contact element adapted to be connected through the local circuitry to each element in every module, and (d) Spacer means between said sub-base panels and the higher order panel, contact elements mounted in said spacer means for electrically connecting the contact element to its appropriate element in a module, and fastening means passing through said spacing means for firmly securing said sub-panel to the higher order control panel, to form a unitary structure of said elements, modules, circuitry and panels.

2. Apparatus according to claim 1 in which the spacer means comprises a plurality of multi-part separable spacer elements, each of said multi-part spacers embodying a group of electrical contact elements for conducting signal or operating current between the higher order panel and said sub-panels.

3. Apparatus according to claim 2 in which the individual elements that are selectively changeable each include a housing made up of two identical parts, means in the parts for maintaining alignment between said parts when in assembled relationship, a bearing for one shaft end in each part, for mounting a rotatable reversible display piece, and an electromagnet comprising a soft iron core and a coil winding connected to remote control for selectively reversing under signal control the aspect of the display piece.

4. Apparatus according to claim 3 in which the electromagnet bears electric contact terminals for interchangeable use with electric lamp parts in contact receptacles mounted on a printed circuit panel.

5. Apparatus according to claim 2 which includes a first printed circuit panel attached to the base of each module, a more general printed circuit panel mountable on said base and bearing said control circuitry, and a single spacing means between said first and second panels bearing a plurality of electrical contacts for conductively connecting plural elements of the control circuitry with the module printed circuit.

6. Apparatus according to claim 2 which includes a plurality of modules each made up of plural rows and plural columns of elements, each element comprising a housing of two identical housing half parts, each half part bearing a ventilation window to permit convection of air currents to dissipate heat in the display, said windows being arranged to prevent transmission of light from one element into another, and means for positively orienting the respective housing parts for current supply and for control of said convection.

7. Apparatus according to claim 2 which includes a plurality of bifurcate flexible connectors and a threaded stud passing through the base panel of the module and engaged by the closed legs of said bifurcate connector, said stud being releasable when the bifurcate legs are permitted to separate.

* * * * *